US009394639B2

(12) United States Patent
Ruggles et al.

(10) Patent No.: US 9,394,639 B2
(45) Date of Patent: Jul. 19, 2016

(54) MOTORIZED THREAD TENSIONER FOR A SEWING MACHINE

(71) Applicant: HANDI QUILTER, INC., North Salt Lake, UT (US)

(72) Inventors: Bryan K. Ruggles, Riverton, UT (US); Wynn Royce Jones, Lehi, UT (US); Richard Kimball Eich, Layton, UT (US)

(73) Assignee: Handi Quilter, Inc., North Salt Lake, UT (US)

( * ) Notice: Subject to any disclaimer, the term of this patent is extended or adjusted under 35 U.S.C. 154(b) by 0 days.

(21) Appl. No.: 14/884,708

(22) Filed: Oct. 15, 2015

(65) Prior Publication Data

US 2016/0108568 A1 Apr. 21, 2016

Related U.S. Application Data

(60) Provisional application No. 62/064,838, filed on Oct. 16, 2014.

(51) Int. Cl.

*D05B 47/00* (2006.01)
*D05B 19/02* (2006.01)
*D05B 47/02* (2006.01)

(52) U.S. Cl.

CPC ..... *D05B 19/02* (2013.01); *D05B 47/02* (2013.01)

(58) Field of Classification Search

CPC ..... D05B 47/00; D05B 47/02; D05B 47/04; D05B 47/06

See application file for complete search history.

(56) References Cited

U.S. PATENT DOCUMENTS

| | | | |
|---|---|---|---|
| 1,020,057 | A | 3/1912 | Ringe |
| 2,694,375 | A | 11/1951 | Attwood |
| 2,698,590 | A | 1/1955 | Garbe |
| 2,741,198 | A | 4/1956 | Attwood et al. |
| 3,146,969 | A | 9/1964 | Elbert |
| 3,206,138 | A | 9/1965 | Elbert |
| 3,266,449 | A | 8/1966 | Heinrich et al. |
| 3,360,213 | A | 12/1967 | Hetzel et al. |
| 3,523,433 | A | 8/1970 | Hatay |
| 3,797,426 | A | 3/1974 | Von Hagen |
| 3,839,972 | A | 10/1974 | Scott et al. |
| 3,875,489 | A | 4/1975 | Von Brimer |
| 3,991,954 | A | 11/1976 | Schwartz |
| 4,013,028 | A | 3/1977 | Murakami |
| 4,098,208 | A | 7/1978 | Hedegaard |
| 4,108,096 | A | 8/1978 | Ciecior |

(Continued)

FOREIGN PATENT DOCUMENTS

EP 254958 A1 2/1988

*Primary Examiner* — Nathan Durham
(74) *Attorney, Agent, or Firm* — Maschoff Brennan

(57) ABSTRACT

Motorized thread tensioner for a sewing machine. In one example embodiment, a motorized thread tensioner for a sewing machine may include a first disk, a second disk, a spring, a shaft having threads on a distal end, a nut threaded onto the threads of the shaft, and an electric motor. The shaft may be through the first disk, the second disk, and the spring. The electric motor may be coupled to the nut and configured to rotate the nut in a first rotational direction and a second rotational direction that is opposite to the first rotational direction. The rotation of the nut in the first rotational direction may cause the shaft to travel toward the electric motor. The rotation of the nut in the second rotational direction may cause the shaft to travel away from the electric motor.

18 Claims, 9 Drawing Sheets

(56) References Cited

U.S. PATENT DOCUMENTS

| | | | | | |
|---|---|---|---|---|---|
| 4,166,423 | A | | 9/1979 | Brienza et al. | |
| 4,186,676 | A | | 2/1980 | Villa et al. | |
| 4,289,087 | A | * | 9/1981 | Takenoya | D05B 47/00 112/254 |
| 4,377,980 | A | * | 3/1983 | Hanyu | D05B 19/12 112/229 |
| 4,388,885 | A | | 6/1983 | Dreier | |
| 4,430,953 | A | | 2/1984 | Spies | |
| 4,458,611 | A | | 7/1984 | Arendash | |
| 4,513,674 | A | | 4/1985 | Bhatia et al. | |
| 4,515,096 | A | | 5/1985 | Ingram | |
| 4,523,440 | A | | 6/1985 | Voisin et al. | |
| 4,539,922 | A | | 9/1985 | Klundt | |
| 4,554,840 | A | | 11/1985 | Marchesi | |
| 4,616,585 | A | | 10/1986 | Marcandalli | |
| 4,776,293 | A | | 10/1988 | Yoshida | |
| 4,821,199 | A | | 4/1989 | Kuhnert | |
| 4,873,931 | A | * | 10/1989 | Takagi | D05B 47/04 112/255 |
| 4,884,763 | A | | 12/1989 | Rydborn | |
| 5,033,400 | A | | 7/1991 | Fischer | |
| 5,086,719 | A | | 2/1992 | Ogawa | |
| 5,092,257 | A | | 3/1992 | Ogawa | |
| 5,097,775 | A | | 3/1992 | Ogawa et al. | |
| 5,294,071 | A | | 3/1994 | Hartel et al. | |
| 5,320,053 | A | | 6/1994 | Beasley | |
| 5,549,062 | A | | 8/1996 | Yamashita et al. | |
| 5,611,499 | A | | 3/1997 | Stokes et al. | |
| 5,651,287 | A | | 7/1997 | Tseng | |
| 5,842,661 | A | | 12/1998 | Hohne et al. | |
| 5,870,960 | A | | 2/1999 | Brown | |
| 6,065,711 | A | | 5/2000 | Plath | |
| 6,089,172 | A | | 7/2000 | Takenoya et al. | |
| 6,095,449 | A | | 8/2000 | Gallo et al. | |
| 6,595,150 | B2 | * | 7/2003 | Yamazaki | D05B 47/04 112/254 |
| 6,748,888 | B1 | | 6/2004 | Chen | |
| 7,007,777 | B2 | | 3/2006 | Gonser et al. | |
| 7,124,697 | B2 | | 10/2006 | Foley | |
| 7,240,628 | B2 | * | 7/2007 | Friman | D05B 69/00 112/475.01 |
| 7,597,058 | B2 | | 10/2009 | Ishikawa et al. | |
| 7,654,209 | B2 | | 2/2010 | Park | |
| 7,661,624 | B2 | | 2/2010 | Akaro et al. | |
| 7,720,552 | B1 | | 5/2010 | Lloyd | |
| 7,845,295 | B2 | | 12/2010 | Park | |
| 7,878,133 | B2 | | 2/2011 | Tokura et al. | |
| 7,971,543 | B2 | | 7/2011 | Nagai et al. | |
| 8,096,251 | B2 | | 1/2012 | Suzuki | |
| 8,448,588 | B1 | | 5/2013 | Lindley | |
| 8,997,669 | B1 | | 4/2015 | Konzak | |
| 2003/0117380 | A1 | | 6/2003 | Kanzaki | |
| 2003/0172860 | A1 | | 9/2003 | Kong | |
| 2004/0103834 | A1 | * | 6/2004 | Foley | D05B 47/04 112/254 |
| 2005/0178307 | A1 | | 8/2005 | Frazer et al. | |
| 2007/0261621 | A1 | | 11/2007 | Suzuki et al. | |
| 2008/0211779 | A1 | | 9/2008 | Pryor | |
| 2008/0216725 | A1 | | 9/2008 | Tokura et al. | |
| 2008/0281442 | A1 | | 11/2008 | Huckemann et al. | |
| 2009/0199752 | A1 | | 8/2009 | James et al. | |
| 2009/0249990 | A1 | | 10/2009 | Park | |
| 2010/0126396 | A1 | | 5/2010 | Stutznacker | |
| 2011/0029865 | A1 | | 2/2011 | Gilland et al. | |
| 2012/0097083 | A1 | | 4/2012 | James et al. | |
| 2012/0210924 | A1 | * | 8/2012 | Kawai | D05B 47/06 112/254 |
| 2012/0226977 | A1 | | 9/2012 | Lengeling et al. | |
| 2012/0312213 | A1 | | 12/2012 | Konzak et al. | |
| 2012/0318181 | A1 | | 12/2012 | Kasa | |
| 2013/0249814 | A1 | | 9/2013 | Zeng | |
| 2014/0266569 | A1 | | 9/2014 | Yoshikawa et al. | |
| 2014/0270256 | A1 | | 9/2014 | Yoshikawa et al. | |

* cited by examiner

MOTORIZED THREAD TENSIONER FOR A SEWING MACHINE

CROSS-REFERENCE TO A RELATED APPLICATION

This application is a continuation of U.S. Patent Application No. 62/064,838, filed Oct. 16, 2014, and titled "MOTORIZED THREAD TENSIONER FOR A SEWING MACHINE," which is incorporated herein by reference in its entirety.

FIELD

The embodiments disclosed herein relate to a motorized thread tensioner for a sewing machine.

BACKGROUND

Sewing machines, such as standard lockstitch sewing machines, generally function to form a row of stitches in one or more layers of fabric using a combination of thread from a spool, also known as top thread, and thread from a bobbin, also known as bottom thread. In order to form a row of stitches that are uniform on both sides of the one or more layers of fabric, consistent and controllable tensions must be applied to the top thread and to the bottom thread so that appropriate amounts of top thread and bottom thread flow from the spool and the bobbin simultaneously during the operation of the sewing machine. Achieving consistent tensions in the top and bottom threads is generally accomplished by running the top and bottom threads through one or more tension devices of the sewing machine, sometimes known as thread tensioners. Some thread tensioners are fixed and others are adjustable.

A typical thread tensioner for the top thread on a sewing machine includes a knob that can be manually rotated by a user in order to vary the tension on the top thread. Typically, as the knob is rotated in one direction, the tension on the top thread increases, and as the knob is rotated in the other direction, the tension on the top thread decreases.

One common difficulty faced by the user of a typical thread tensioner is knowing how many rotations and/or partial rotations of the knob are necessary to achieve optimal tension on the top thread. This difficulty is due in part to threads of different types requiring different tensions. Since the thread tensioner may need adjustment as the user switches from one type of thread to another, replicating an optimal tension on a particular type of thread may require the user to track the number of rotations and/or partial rotations of the knob, for example, and then remember this number of rotations and/or partial rotations the next time the same particular type of thread is used. This can be a cumbersome process fraught with errors. It may therefore be difficult for the user of a typical thread tensioner to achieve optimal tension on the top thread while operating a sewing machine.

The subject matter claimed herein is not limited to embodiments that solve any disadvantages or that operate only in environments such as those described above. Rather, this background is only provided to illustrate one example technology area where some embodiments described herein may be practiced.

SUMMARY

In general, example embodiments described herein relate to a motorized thread tensioner for a sewing machine. The example motorized thread tensioner disclosed herein may include first and second disks between which a thread may be positioned, a spring configured to exert a force against the second disk to cause friction on the thread, and an electric motor. The electric motor may be configured to compress the spring to apply increased friction to the thread or to decompress the spring to apply decreased friction to the thread. The friction applied to the thread between the first and second disks then correlates with the longitudinal tension on the thread when the thread is pulled through the first and second disks. The electric motor may be controlled by preset tension controls to allow a user to easily achieve optimal tensions as the user switches from one type of thread to another. The example motorized thread tensioner disclosed herein may therefore enable a user to easily achieve optimal tension on the top thread while operating a sewing machine.

In one example embodiment, a motorized thread tensioner for a sewing machine may include a first disk, a second disk positioned next to the first disk, a spring configured to apply friction to a thread that is positioned between the first disk and the second disk by exerting a force against the second disk, a shaft having a head on a proximal end and threads on a distal end, a nut threaded onto the threads of the shaft, and an electric motor. The shaft may be through the first disk, the second disk, and the spring. The electric motor may be coupled to the nut and configured to rotate the nut in a first rotational direction and a second rotational direction that is opposite to the first rotational direction. The rotation of the nut in the first rotational direction may cause the shaft to travel toward the electric motor which causes the spring to compress to apply increased friction to the thread. The rotation of the nut in the second rotational direction may cause the shaft to travel away from the electric motor which causes the spring to decompress to apply decreased friction to the thread.

In another example embodiment, a motorized thread tensioner for a sewing machine may include a first disk, a second disk positioned next to the first disk, a spring configured to apply friction to a thread that is positioned between the first disk and the second disk by exerting a force against the second disk, an electric motor, an electronic display device, one or more processors, and one or more non-transitory computer-readable media. The motor may be configured to cause the spring to compress to apply increased friction to the thread. The electric motor may be further configured to cause the spring to decompress to apply decreased friction to the thread. The one or more non-transitory computer-readable media may store one or more programs that are configured, when executed, to cause the one or more processors to generate and visually present, on the electronic display device, a first graphical user interface (GUI) tension preset control and a second GUI tension preset control. The first GUI tension preset control may be configured to store a first preset tension and the second GUI tension preset control may be configured to store a second preset tension that is different than the first preset tension. The first GUI tension preset control may be configured, upon receipt of a first input from a user, to send a first electronic signal to the electric motor to cause the electric motor to cause the spring to compress or decompress to apply the first preset tension to the thread. The second GUI tension preset control may be configured, upon receipt of a second input from the user, to send a second electronic signal to the electric motor to cause the electric motor to cause the spring to compress or decompress to apply the second preset tension to the thread.

In another example embodiment, a sewing machine may include a needle bar configured to have a needle attached thereto and configured to reciprocate the needle having a thread threaded thereon into and out of a fabric, and a motorized thread tensioner. The motorized thread tensioner may include a first disk, a second disk positioned next to the first disk, a spring configured to apply friction to the thread, a portion of which being positioned between the first disk and the second disk, by exerting a force against the second disk, a shaft having a head on a proximal end and threads on a distal end, the shaft being positioned through the first disk, the second disk, and the spring, a nut threaded onto the threads of the shaft, an electric motor, an electronic display device, one or more processors, and one or more non-transitory computer-readable media. The electric motor may be coupled to the nut and may be configured to rotate the nut in a first rotational direction and a second rotational direction that is opposite to the first rotational direction. The rotation of the nut in the first rotational direction may cause causing the shaft to travel toward the electric motor which causes the spring to compress to apply increased friction to the thread. The rotation of the nut in the second rotational direction may cause the shaft to travel away from the electric motor which causes the spring to decompress to apply decreased friction to the thread. The one or more non-transitory computer-readable media may store one or more programs that are configured, when executed, to cause the one or more processors to generate and visually present, on the electronic display device, a first graphical user interface (GUI) tension preset control and a second GUI tension preset control. The first GUI tension preset control may be configured to store a first preset tension and the second GUI tension preset control may be configured to store a second preset tension that is different than the first preset tension. The first GUI tension preset control may be configured, upon receipt of a first input from a user, to send a first electronic signal to the electric motor to cause the electric motor to rotate the nut in the first or second rotational direction to apply the first preset tension to the thread. The second GUI tension preset control may be configured, upon receipt of a second input from the user, to send a second electronic signal to the electric motor to cause the electric motor to rotate the nut in the first or second rotational direction to apply the second preset tension to the thread.

It is to be understood that both the foregoing general description and the following detailed description are exemplary and explanatory and are not restrictive of the invention as claimed.

BRIEF DESCRIPTION OF THE DRAWINGS

Example embodiments will be described and explained with additional specificity and detail through the use of the accompanying drawings in which.

DESCRIPTION OF EMBODIMENTS

Figure 1A:
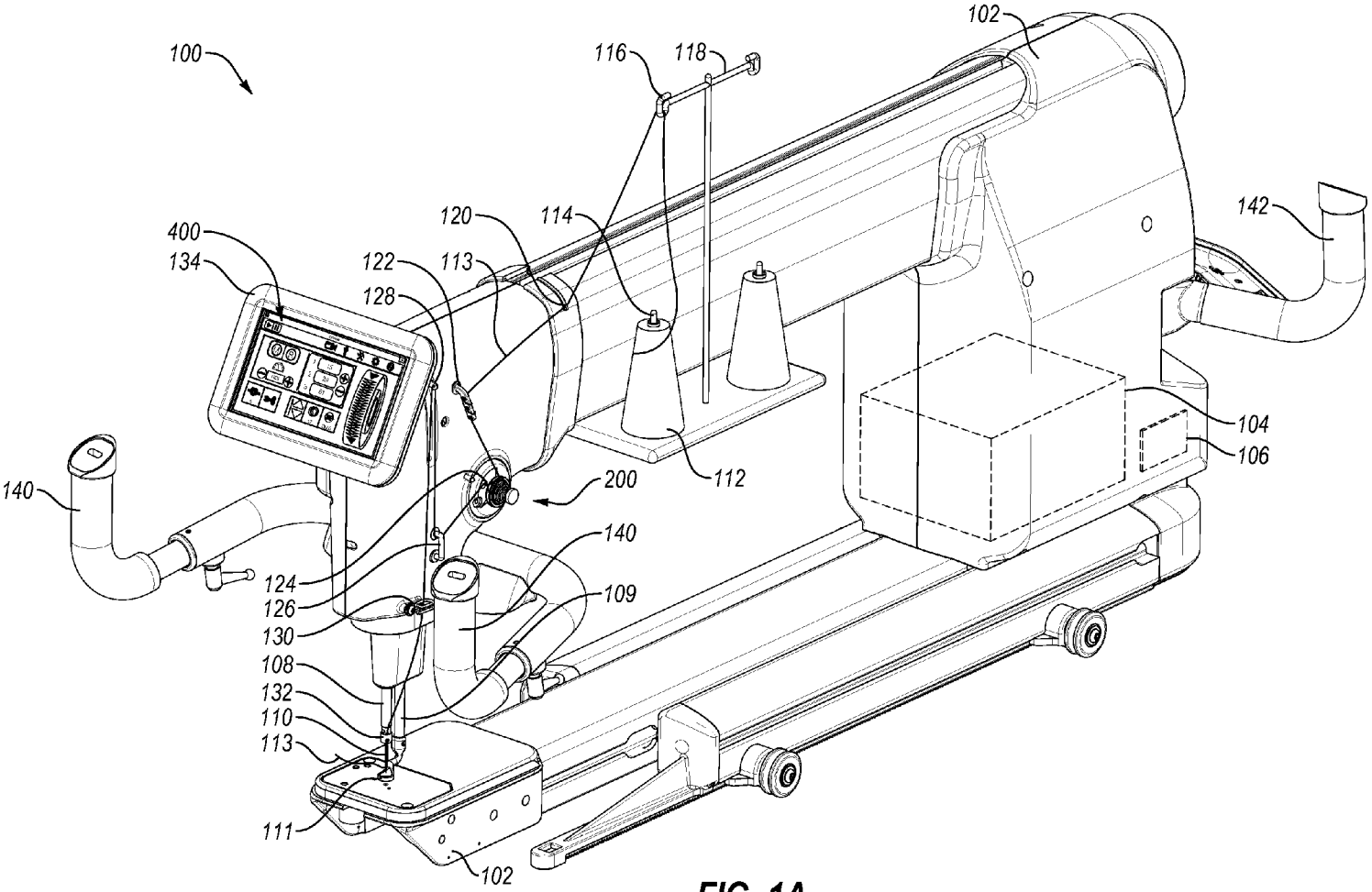
FIG. 1A is a front perspective view of an example sewing machine including an example motorized thread tensioner.
Figure 1B:
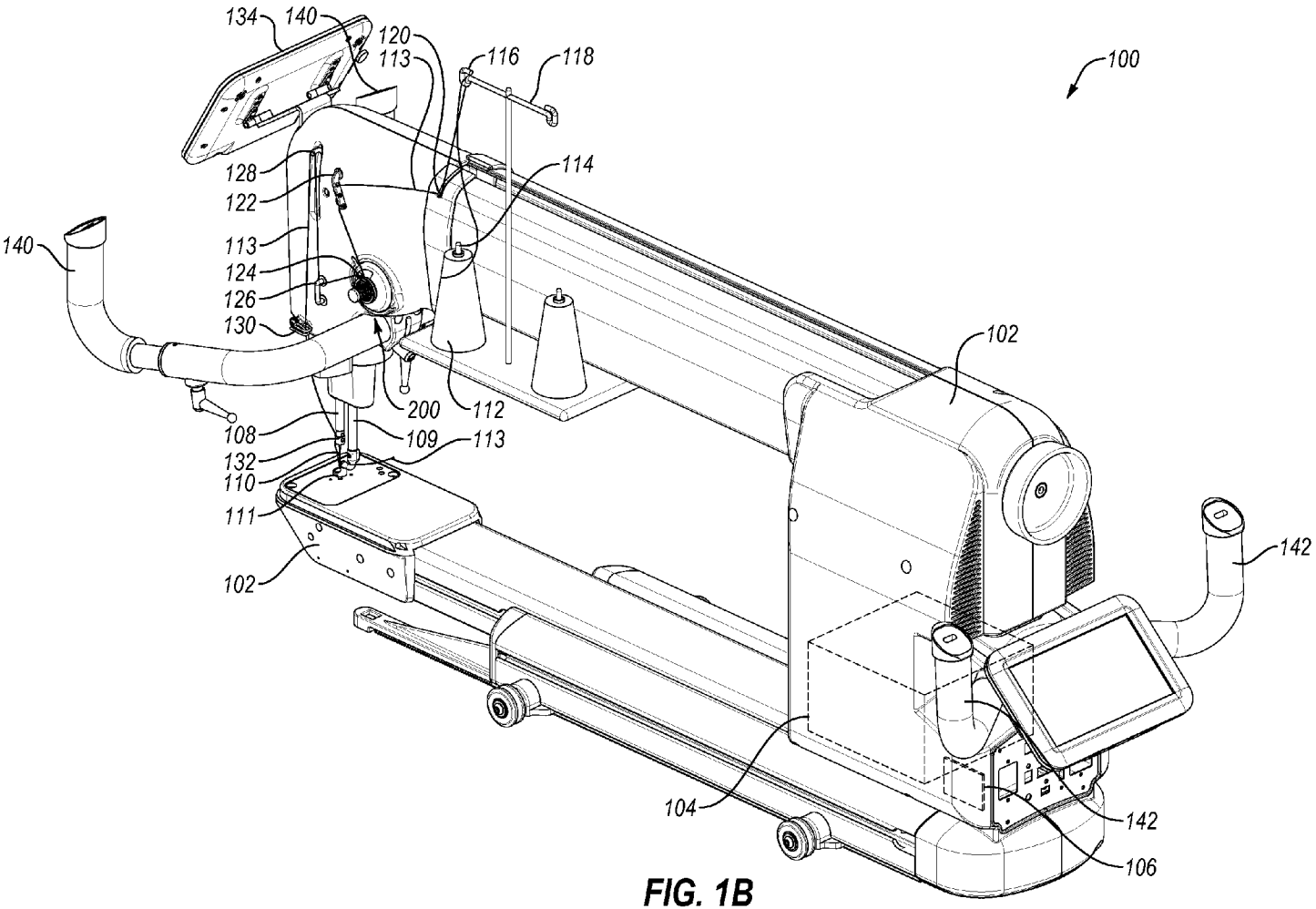
FIG. 1B is a rear perspective view of the example sewing machine of FIG. 1A.

FIG. 1A is a front perspective view of an example sewing machine 100 including an example motorized thread tensioner 200, and FIG. 1B is a rear perspective view of the example sewing machine 100. The example sewing machine 100 of FIGS. 1A and 1B is specialized for quilting and is known as a long-arm quilting machine. Some features of a long-arm quilting machine that distinguish it from other types of sewing machines is the "long-arm" configuration of the machine, handlebars (such as the handlebars 140 and 142 discussed below), and a hopping foot (such as the hopping foot 111 discussed below). Quilting typically involves stitching together multiple layers of fabric to form a quilt. A quilt typically includes a layer of batting sandwiched in between upper and lower layers of fabric.

As disclosed in FIGS. 1A and 1B, the sewing machine 100 may include one or more housings 102 which house various internal components such as a motor 104 and one or more processors 106. The sewing machine 100 may also include the example motorized thread tensioner 200 and an example display device 134. The example display device 134 may be any type of electronic display device, such as a liquid crystal display (LCD) resistive or capacitive touchscreen or other touchscreen input/output display device, and may be integral to or separable from the sewing machine 100. The example display device 134 may display a graphical user interface (GUI), such as the GUI 400 or a GUI 500, as discussed in greater detail below in connection with FIGS. 4 and 5. The sewing machine 100 may also include a needle bar 108 that is configured to have a needle 110 attached thereto and a presser bar 109 having a hopping foot 111 attached thereto. The needle 110 may be configured to be threaded with a top thread 113.

The threading of the needle 110 with the top thread 113 may be accomplished as follows. First, a spool 112 of the top thread 113 may be placed on a spool holder 114, which in the illustrated embodiment is known as a spool pin. Next, the top thread 113 may be passed through an eyelet 116 of a thread mast 118, a thread guide 120, and a three-hole thread guide 122. Then, the top thread 113 may be positioned between opposing disks of the example motorized thread tensioner 200 by "flossing" the top thread 113 between the opposing disks. Next, the top thread 113 may be passed through a take-up spring 124, a stirrup 126, a take-up lever 128, a thread guide 130, and a thread guide 132. Finally, the top thread 113 may be threaded through the eye of the needle 110.

Although not shown in FIGS. 1A and 1B, it is understood that the sewing machine may also include a bobbin case configured to hold a bobbin that is wound with bottom thread, and a bobbin hook, both generally positioned in the housing 102 underneath a needle plate that is positioned underneath the needle 110.

During operation of the sewing machine 100, the user may employ the handlebars 140 or the handlebars 142 to move the sewing machine 100 over the stationary layers of fabric during operation of the sewing machine 100. The motor 104 may be configured to reciprocate the threaded needle 110 having the top thread 113 threaded thereon into and out of one or more layers of fabric (not shown). Simultaneously, the motor 104 may be configured to repeatedly drive the bobbin hook to catch the top thread 113 (which has been driven through the one or more layers of fabric) and loop the top thread 113 around the bobbin to form a row of stitches of the top thread 113 and the bottom thread in the one or more layers of fabric. Also simultaneously, the hopping foot 111 may be reciprocated up and down, onto and off of the top of the one or more layers of fabric (i.e., in a "hopping" motion), to alternate between holding and compressing the one or more layers of fabric in place during the finalization of each stitch and releasing the one or more layers of fabric to facilitate the movement of the sewing machine 100 and/or the movement of the one or more layers of fabric between each stitch.

In order for this row of stiches to be uniform and balanced on both sides of the one or more layers of fabric, consistent tensions must be applied to the top thread 113 and to the bottom thread so that appropriate amounts of top thread 113 and bottom thread flow from the spool 112 and the bobbin simultaneously during operation of the sewing machine 100. Achieving consistent tension in the bottom thread may generally be accomplished using a bottom thread tensioner (not shown) that functions in connection with, and may be integral with, the bobbin case. Achieving consistent tension in the top thread 113 may generally be accomplished using the example motorized thread tensioner 200.

As discussed in greater detail below in connection with FIGS. 2A and 2B, an electric motor 202 of the example motorized thread tensioner 200 of FIGS. 1A and 1B may be configured to apply increased tension to the top thread 113 or to apply decreased tension to the top thread 113. The electric motor may additionally be controlled by preset tension controls to allow a user to easily achieve optimal tensions as the user switches from one type of thread to another. The one or more processors 106 may be in electronic communication with the electric motor of the example motorized thread tensioner 200 and may be configured to control the electric motor in order to apply a particular tension to the top thread 113 by the example motorized thread tensioner 200, and also to keep track of the current tension that is applied by the spring of the example motorized thread tensioner 200 using an optical sensor, as discussed below. The display device 134 may be in electronic communication with the one or more processors 106 and may be configured to display the current tension in real time, as well as allow the user to modify the current tension, as discussed in greater detail in connection with FIGS. 4 and 5. Thus, the user may employ the example motorized thread tensioner 200 to achieve an optimal tension for the particular type of the top thread 113.

Although the example sewing machine 100 of FIGS. 1A and 1B is a long-arm quilting machine, it is understood that the sewing machine 100 of FIGS. 1A and 1B is only one of countless sewing machines in which the example motorized thread tensioner 200 may be employed. The scope of the example motorized thread tensioner 200 is therefore not intended to be limited to employment in any particular sewing machine.

Figure 2A:
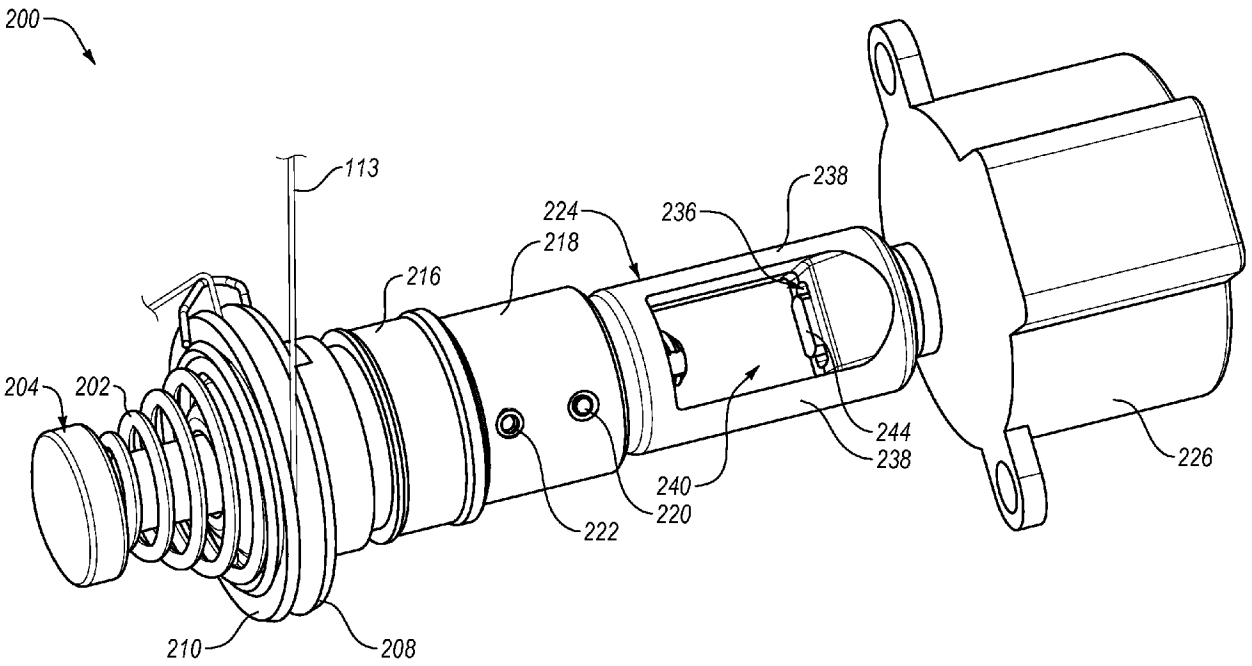
FIG. 2A is a perspective view of the example motorized thread tensioner of FIG. 1A including an example tensioner spring.
Figure 2B:
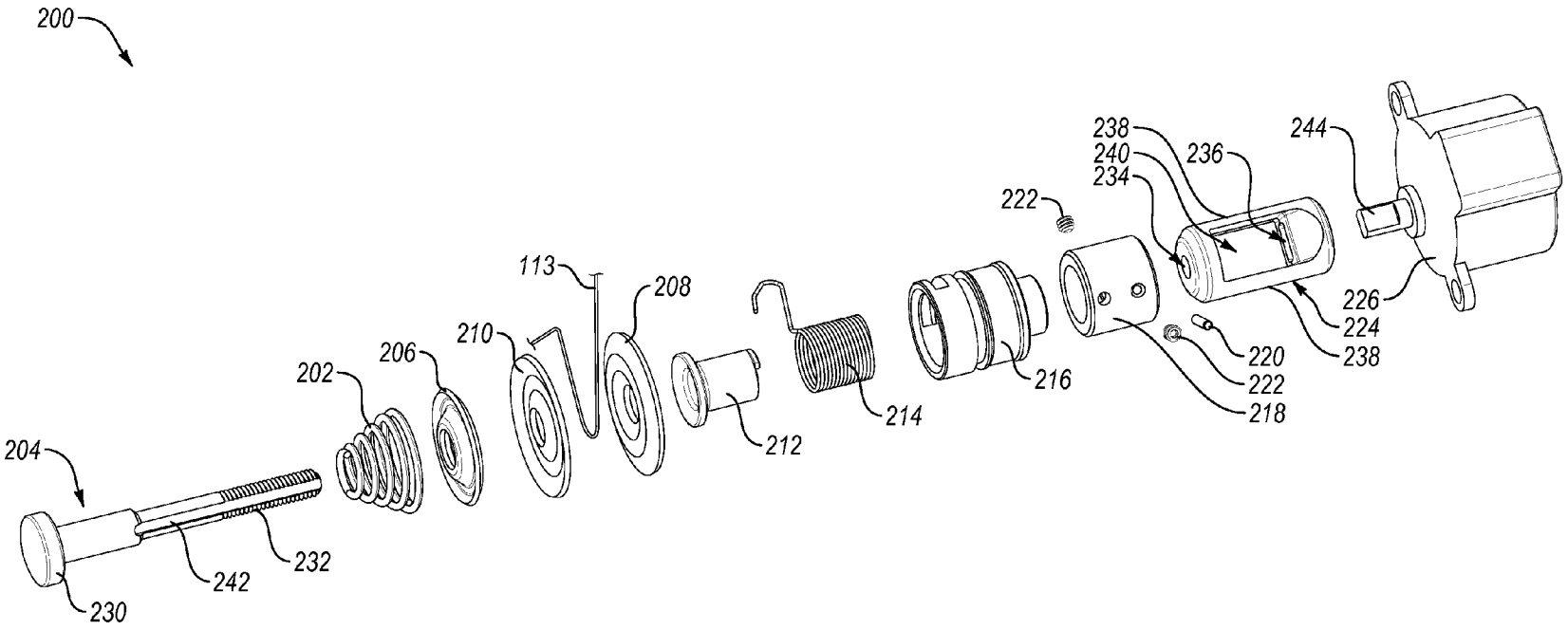
FIG. 2B is an exploded perspective view of the example motorized thread tensioner of FIG. 2A.

FIG. 2A is a perspective view of the example motorized thread tensioner 200 including an example tensioner spring 202 and FIG. 2B is an exploded perspective view of the example motorized thread tensioner 200. As disclosed in FIGS. 2A and 2B, the example motorized thread tensioner may include the tensioner spring 202, a shaft 204, a tensioner spring base 206, a first disk 208, a second disk 210, a holder 212, a check spring 214, a barrel 216, a guide collar 218, guide pin 220, set screws 222, a coupler nut 224, and an electric motor 226.

The second disk 210 may be positioned next to the first disk 208, and a portion of the top thread 113 may be positioned between the first disk 208 and the second disk 210. The tensioner spring 202 may be configured to apply friction to the top thread 113 that is positioned between the first disk 208 and the second disk 210 by exerting a force against the second disk 210.

The shaft 204 may have a head 230 on a proximal end and threads 232 on a distal end. The shaft 204 may be positioned through the tensioner spring 202, the tensioner spring base 206, the first disk 208, the second disk 210, the holder 212, the check spring 214, the barrel 216, the guide collar 218, and the coupler nut 224.

The coupler nut 224 may include a proximal end that defines a threaded opening 234 that threads onto the threads 232 of the shaft 204. The coupler nut 224 may further include a distal end that defines a slot 236. The coupler nut 224 may further include rails 238 running between the proximal end and the distal end that define an open cavity 240 between the rails 238 into which the distal end of the shaft 204 may extend as the coupler nut 224 is threaded onto the threads 232 of the shaft 204.

The set screws 222 of the guide collar 218 may couple the guide collar 218 to the barrel 216. The guide pin 220 of the guide collar 218 may be positioned within a groove 242 defined in the shaft 204. The guide collar 218 and the barrel 216 may be fixed in place so that they cannot rotate, and the positioning of the guide pin 220 of the guide collar 218 within the groove 242 of the shaft 204 may prevent the shaft 204 from rotating.

The electric motor 226 may be an electric gearmotor and may include a shaft with flats 244 that extends into the slot 236 defined in the distal end of the coupler nut 224. The shaft with flats 244 may be configured to rotate in order to rotate the coupler nut 224. The control of the electric motor 226, including the rotation of the shaft with flats 244, may be controlled by electronic signals received from the example display device 134, as discussed in greater detail below in connection with FIGS. 4 and 5.

Figure 3A:
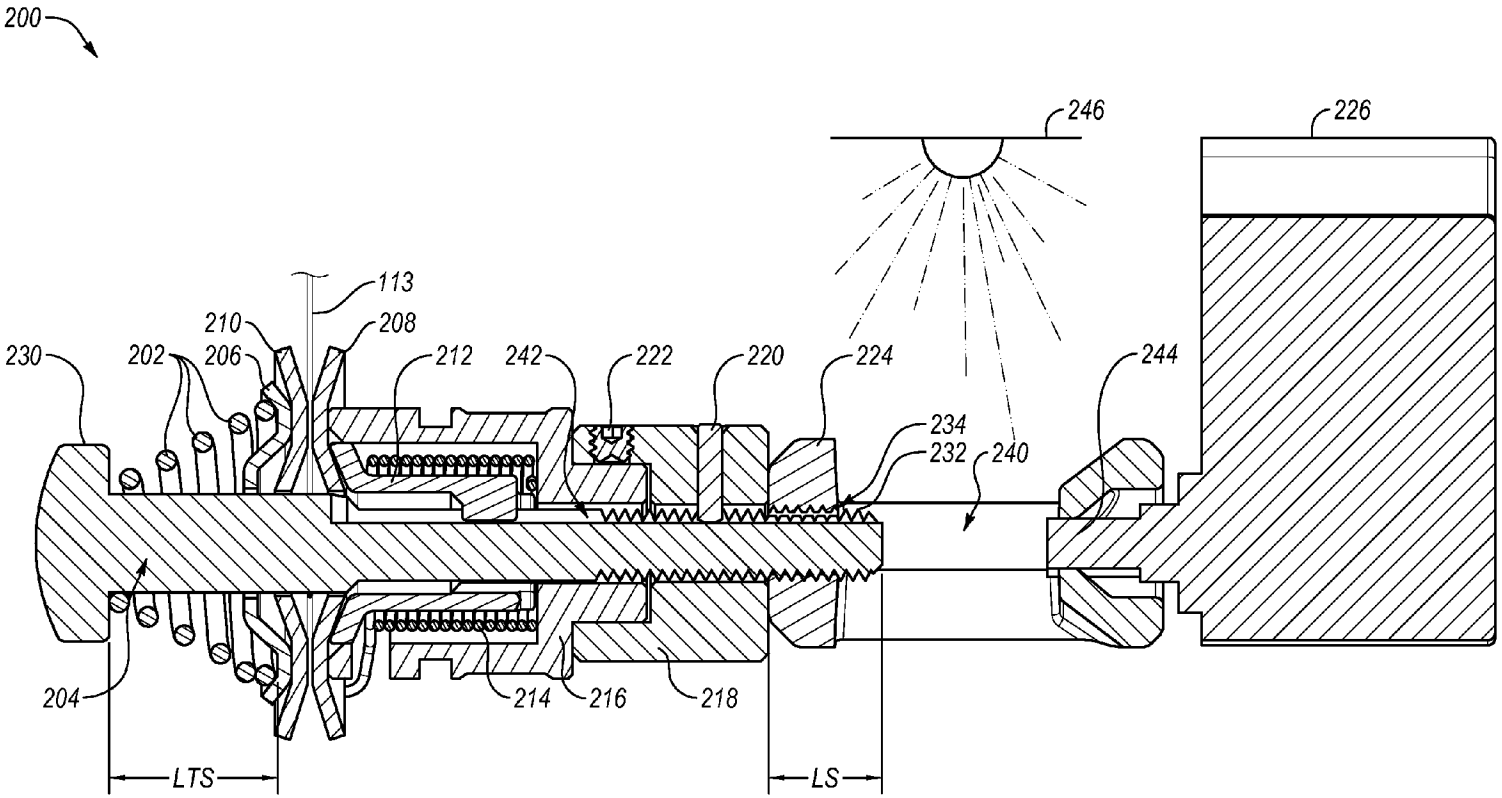
FIG. 3A is a cross-sectional side view of the example motorized thread tensioner of FIG. 2A with the example tensioner spring in an uncompressed state.
Figure 3B:
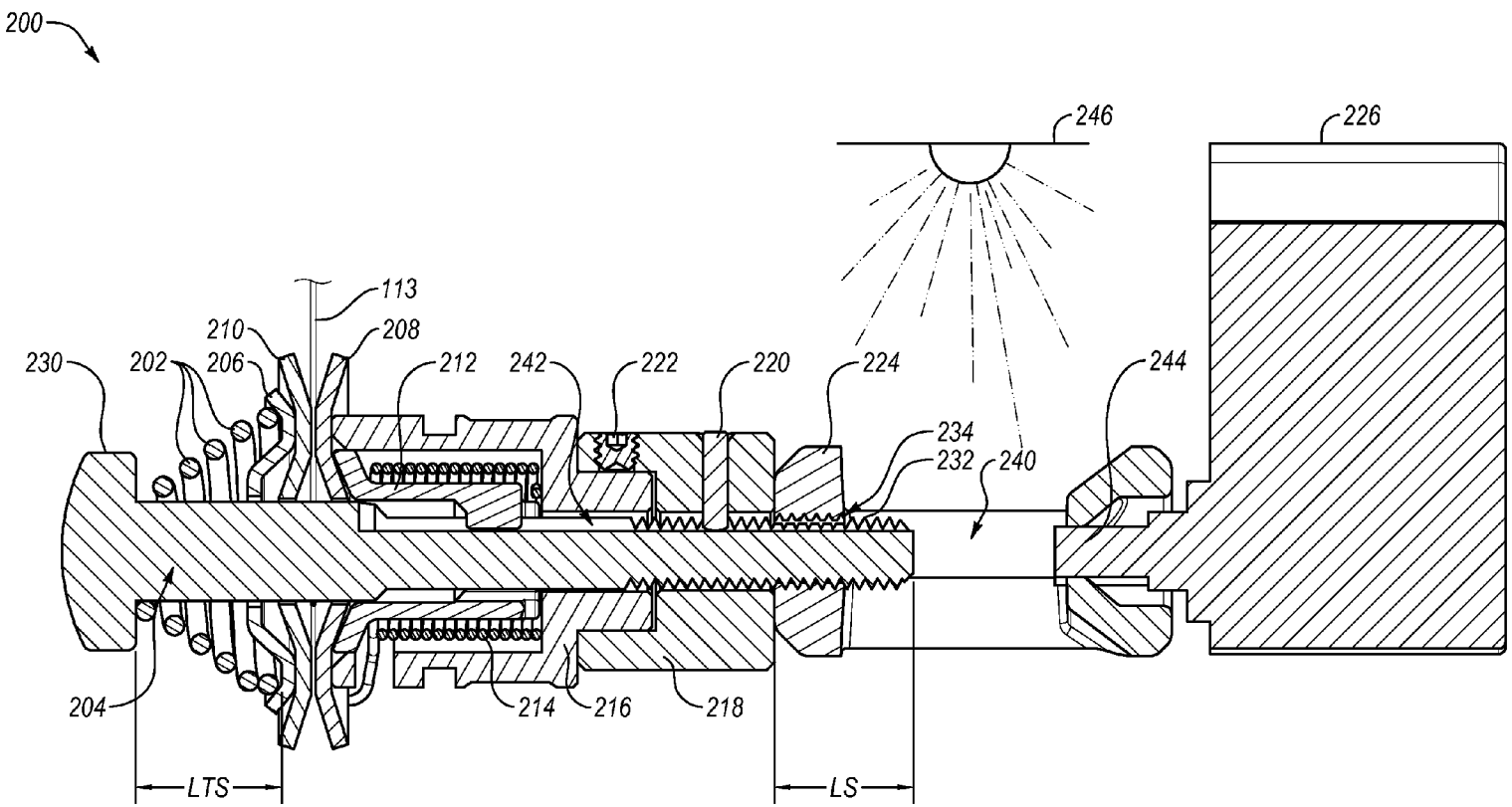
FIG. 3B is a cross-sectional side view of the example motorized thread tensioner of FIG. 2A with the example tensioner spring in a partially compressed state.
Figure 3C:
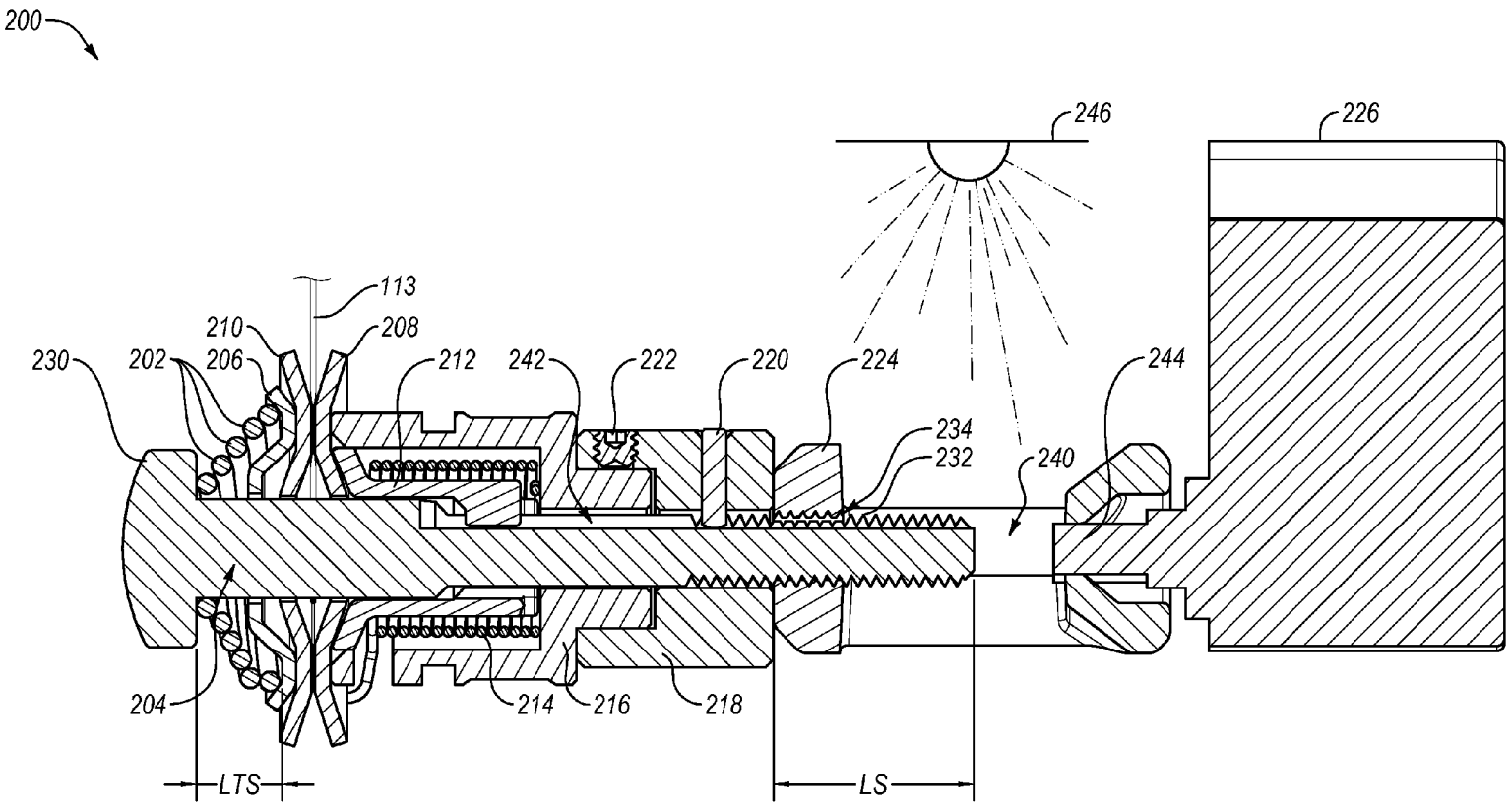
FIG. 3C is a cross-sectional side view of the example motorized thread tensioner of FIG. 2A with the example tensioner spring in a fully compressed state.

FIG. 3A is a cross-sectional side view of the example motorized thread tensioner 200 with the example tensioner spring 202 in an uncompressed state, FIG. 3B is a cross-sectional side view of the example motorized thread tensioner 200 with the example tensioner spring 202 in a partially compressed state, and FIG. 3C is a cross-sectional side view of the example motorized thread tensioner 200 with the example tensioner spring 202 in a fully compressed state.

As disclosed in the progression from FIG. 3A to FIG. 3C, as the electric motor 226 turns the coupler nut 224 in a first rotational direction, which is a clockwise direction in this example embodiment, the shaft 204 may be prevented from rotating, which causes the shaft 204 to travel laterally (to the right in FIGS. 3A-3C) toward the electric motor 226 while the barrel 216/guide collar 218 remain stationary. Therefore, this lateral travel of the shaft 204 (to the right in FIGS. 3A-3C) causes the tensioner spring 202 to compress (i.e., the length LTS of the tensioner spring 202 is shortened) between the head 230 of the shaft 204 and the tensioner spring base 206, which applies increased friction to the top thread 113 that is positioned between the first disk 208 and the second disk 210 due to loading of the tensioner spring 202. The lateral movement of the shaft 204 (to the right in FIGS. 3A-3C) during the shortening of the length LTS of the tensioner spring 202 causes the length LS of the shaft 204 that extends into the open cavity 240 to lengthen in inverse proportion to the shortening of the length LTS of the tensioner spring 202.

The current tension applied by the tensioner spring 202 may be determined using a sensor 246 that is positioned proximate the open cavity 240. Although the sensor 246 is disclosed in FIGS. 3A-3C as an optical sensor, it is understood that the sensor 246 may be replaced or augmented by another type of sensor, such as a sensor configured according to any of the sensor configurations disclosed in U.S. Pat. No. 8,997,669, titled "THREAD TENSIONER FOR A SEWING MACHINE," which issued on Apr. 7, 2015, which is expressly incorporated herein by reference in its entirety. Further, it is understood that the sensor 246 may be included in any of the components of the example motorized thread tensioner 200, such as the coupler nut 224, the barrel 216, the guide collar 218, or any another component of the sewing machine 100. For example, the sensor 246 may be positioned on one or both of the rails 238 of the coupler nut 224.

The sensor 246 may be employed, for example, to track the length LS of the shaft 204 that extends into the open cavity 240, the current position of the distal end of the shaft 204, how far the coupler nut 224 is threaded onto the threads 232 of the shaft 204, the number of rotations or partial rotations of the shaft with flats 244 of the electric motor 226 or of the coupler nut 224, or other relative positions or movements of the components of the example motorized thread tensioner 200, or some combination thereof. Tracking any of this data can allow this data to be used to calculate the current length of the tensioner spring 202, which can be used to determine the current amount of tension that is being exerted by the tensioner spring 202 against the second disk 210, which can be used to determine how much tension is currently applied to the top thread 113 that is flossed between the first disk 208 and the second disk 210. This determination may be made by the one or more processors 106, disclosed in connection with FIGS. 1A and 1B, which may be in electronic communication with the sensor 246. This determination may be made by the one or more processors 106 calculating the current load of the tensioner spring 202 given the difference between the free length of the tensioner spring 202, which is the length of the coils of the tensioner spring 202 in an unloaded and uncompressed state, and the current length LTS of the tensioner spring 202, as determined by the sensor 246.

In contrast, as disclosed in the reverse progression from FIG. 3C to FIG. 3A, as the electric motor 226 turns the coupler nut 224 in a second rotational direction that is opposite to the first rotational direction, which is a counterclockwise direction in this example embodiment, the shaft 204 may be prevented from rotating, which causes the shaft 204 to travel laterally (to the left in FIGS. 3C-3A) away from the electric motor 226 while the barrel 216/guide collar 218 remain stationary. This lateral travel of the shaft 204 (to the left in FIGS. 3C-3A) causes the tensioner spring 202 to decompress (i.e., the length LTS of the tensioner spring 202 is lengthened) between the head 230 of the shaft 204 and the tensioner spring base 206, which applies decreased friction to the top thread 113 that is positioned between the first disk 208 and the second disk 210 due to the unloading of the tensioner spring 202. The lateral movement of the shaft 204 (to the left in FIGS. 3C-3A) during the lengthening of the length LTS of the tensioner spring 202 causes the length LS of the shaft 204 that extends into the open cavity 240 to shorten in inverse proportion to the lengthening of the length LTS of the tensioner spring 202, which may be tracked by the sensor 246.

It is understood that the sensor 246 may additionally or alternatively be employed to track a relative motion a component, such as a number of rotations or partial rotations of the shaft with flats 244 of the electric motor 226 and/or of the coupler nut 224, which tracking may then be employed to calculate the current tension on the top thread 113. It is further understood that the sensor 246 may additionally or alternatively be a sensor that employs magnets, such as a Hall effect sensor, to track the number of rotations or partial rotations of the coupler nut 224. For example, one or more magnets may be positioned on the coupler nut 224, and a Hall effect sensor may track the number of rotations by tracking variations in a magnetic field of the magnets.

It is understood that the threads 232 of the shaft 204 and the threads of the threaded opening 234 of the coupler nut 224 may be reversed to where the first rotational direction is a counterclockwise direction and the second rotational direction is a clockwise direction. It is further understood that although the tensioner spring 202 is in direct contact with the head 230 of the shaft 204 and is only indirectly exerting a force against the second disk 210 through the tensioner spring base 206, this arrangement may be rearranged to where the tensioner spring 202 is in direct contact with the second disk 210 and/or is only indirectly exerting a force against the head 230 of the shaft 204.

Figure 4:
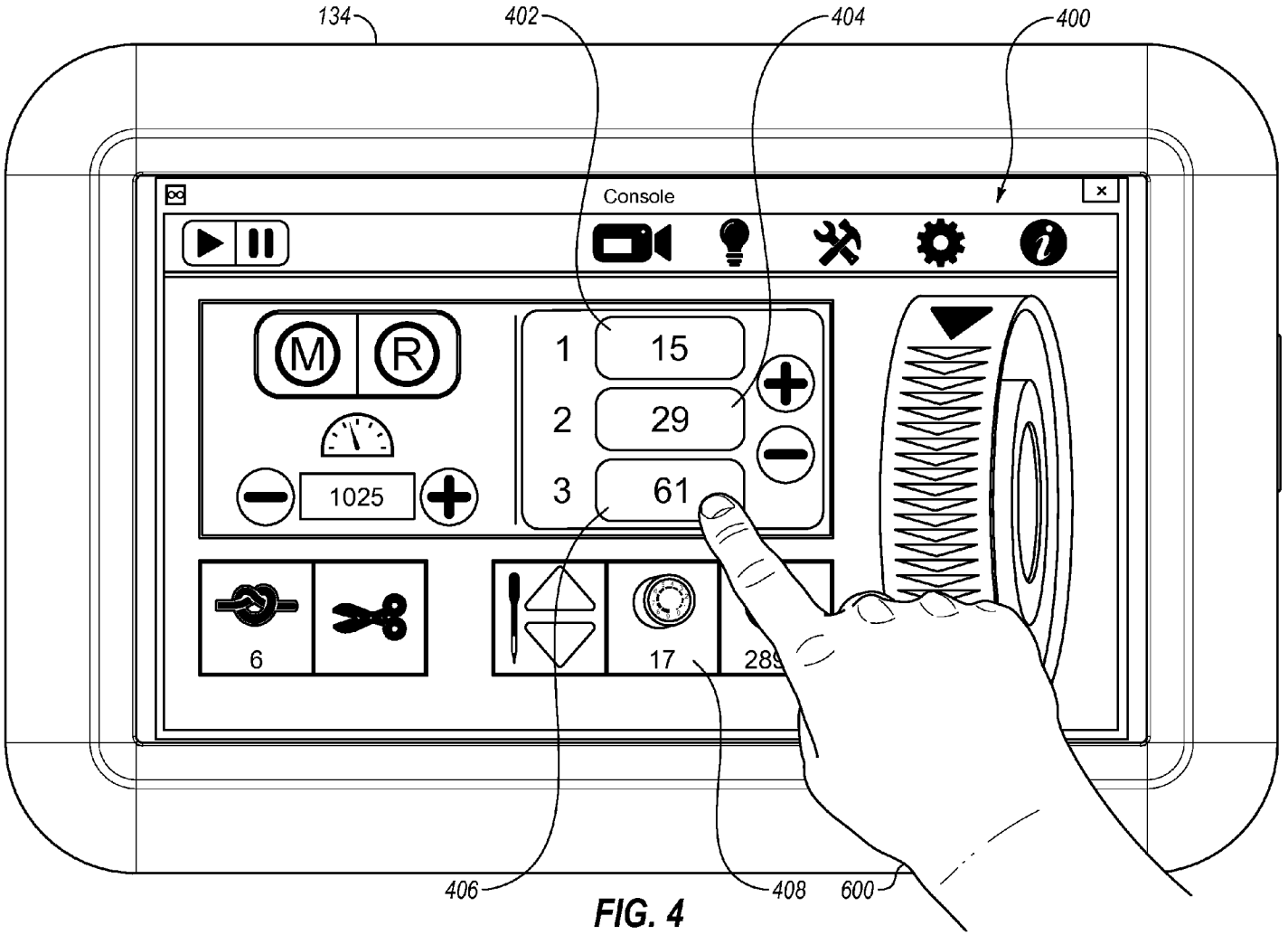
FIG. 4 is a view of an example graphical user interface (GUI) for the example motorized thread tensioner of FIG. 1A being manipulated by a user.
Figure 5:
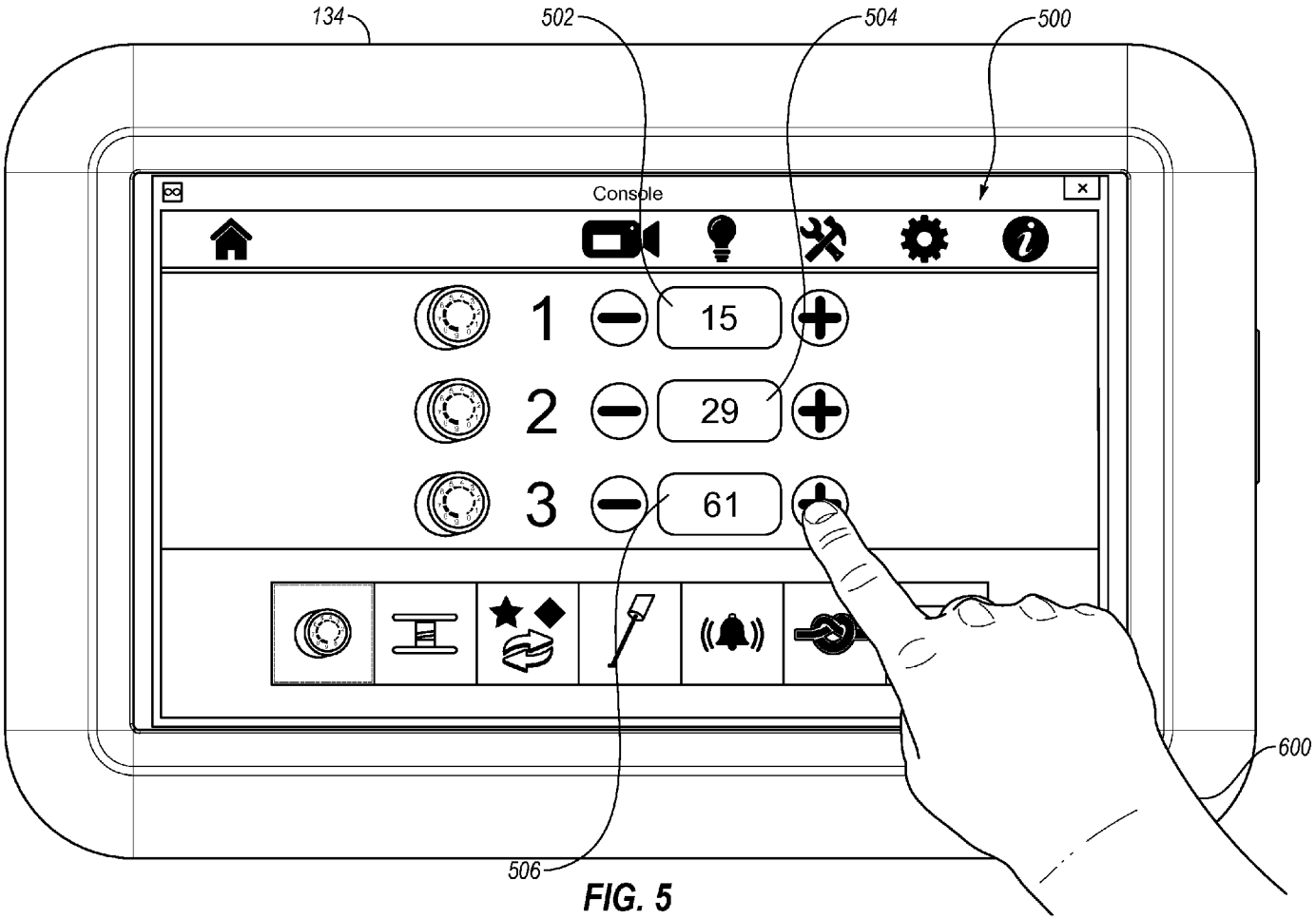
FIG. 5 is a view of another example GUI for the example motorized thread tensioner of FIG. 1A being manipulated by the user.

FIG. 4 is a view of an example graphical user interface (GUI) 400 for the example motorized thread tensioner 200 being manipulated by a user 600. FIG. 5 is a view of another example GUI 500 for the example motorized thread tensioner 200 being manipulated by the user 600. The GUI 400 of FIG. 4 and the GUI 500 of FIG. 5 may be displayed to the user on the display device 134 disclosed in FIG. 1A. For example, one or more non-transitory computer-readable media may store one or more programs that are configured, when executed, to cause the one or more processors 106 of FIG. 1A to generate and visually present, on the display device 134, the GUI 400 of FIG. 4 and the GUI 500 of FIG. 5.

The GUI 400 of FIG. 4 includes GUI tension preset buttons 402, 404, and 406 which are configured to store preset tensions of 15, 29, and 61, respectively. The preset tensions of 15, 29, and 61 may be displayed on the GUI tension preset buttons 402, 404, and 406, respectively. Additionally or alternatively, the preset tensions of 15, 29, and 61 may be displayed near the GUI tension preset buttons 402, 404, and 406, respectively. Each of the preset tensions may be stored and displayed in terms of a number in units that are unique to the sewing machine 100 of FIGS. 1A and 1B, or may be displayed in terms of a number in standard units. The user 600 may select any of the GUI tension preset buttons 402, 404, and 406 to set the current tension that the example motorized thread tensioner 200 of FIGS. 1A and 1B applies to the top thread 113 to the preset tension of the tension preset button. This setting of the current tension may include the selected GUI tension preset button 402, 404, or 406, upon selection by the user 600, sending an electronic signal to the electric motor to cause the electric motor 226 to cause the tensioner spring 202 to compress or decompress to apply the preset tension of the button to the top thread 113, as disclosed in FIGS. 3A-3C. Next to the tension preset buttons are '+' and '−' buttons, which the user 600 can also select in order to increase or decrease, respectively, the current tension on the top thread 113, which as shown in the current tension 408, is currently set at '17' in the GUI 400 of FIG. 4.

Although the GUI tension controls are disclosed in FIG. 4 as GUI buttons, it is understood that other GUI tension controls may be employed, such as GUI checkboxes and GUI radio buttons. Further, although selection of GUI buttons is disclosed in FIG. 4, it is understood that other types of user input to GUI tension controls may be employed to use the GUI 400 to control the example motorized thread tensioner 200.

The GUI 500 of FIG. 5 includes data entry fields 502, 504, and 506 that correspond to the GUI tension preset buttons 402, 404, and 406 of the GUI 400 of FIG. 4, respectively. The data entry fields 502, 504, and 506 each includes a '+' button and a '−' button, which the user can select in order to adjust (i.e., increase or decrease) the preset tension assigned to the corresponding GUI tension preset button. In this manner, the user can change and save the preset tension of any of the GUI tension preset buttons 402, 404, and 406 of the GUI 400 of FIG. 4. Therefore, the GUI 400 of FIG. 4 and the GUI 500 of FIG. 5 may be employed by the user 600 to adjust the current tension applied to the top thread 113 by the example motorized thread tensioner 200, as well as to view the current tension that is being applied to the top thread 113 by the example motorized thread tensioner 200.

The embodiments described herein may include the use of a special-purpose or general-purpose computer, including various computer hardware or software modules, as discussed in greater detail below.

Embodiments described herein may be implemented using non-transitory computer-readable media for carrying or having computer-executable instructions or data structures stored thereon. Such computer-readable media may be any available media that may be accessed by a general-purpose or special-purpose computer. By way of example, and not limitation, such computer-readable media may include non-transitory computer-readable storage media including RAM, ROM, EEPROM, CD-ROM or other optical disk storage, magnetic disk storage or other magnetic storage devices, or any other storage medium which may be used to carry or store one or more desired programs having program code in the form of computer-executable instructions or data structures and which may be accessed and executed by a general-purpose computer, special-purpose computer, or virtual computer such as a virtual machine. Combinations of the above may also be included within the scope of computer-readable media.

Computer-executable instructions comprise, for example, instructions and data which, when executed by one or more processors, cause a general-purpose computer, special-purpose computer, or virtual computer such as a virtual machine to perform a certain method, function, or group of methods or functions. Although the subject matter has been described in language specific to structural features and/or methodological steps, it is to be understood that the subject matter defined in the appended claims is not necessarily limited to the specific features or steps described above. Rather, the specific features and steps described above are disclosed as example forms of implementing the claims.

As used herein, the term "program" may refer to software objects or routines that execute on a computing system. The different programs described herein may be implemented as objects or processes that execute on a computing system (e.g., as separate threads). While the GUIs described herein are preferably implemented in software, implementations in hardware or a combination of software and hardware are also possible and contemplated.

All examples and conditional language recited herein are intended for pedagogical objects to aid the reader in understanding the example embodiments and the concepts contributed by the inventor to furthering the art, and are to be construed as being without limitation to such specifically-recited examples and conditions.

The invention claimed is:

1. A motorized thread tensioner for a sewing machine, the motorized thread tensioner comprising:

a first disk;

a second disk positioned next to the first disk;

a spring configured to apply friction to a thread that is positioned between the first disk and the second disk by exerting a force against the second disk;

a shaft having a head on a proximal end and threads on a distal end, the shaft being positioned through the first disk, the second disk, and the spring;

a nut threaded onto the threads of the shaft; and an electric motor coupled to the nut and configured to rotate the nut in a first rotational direction and a second rotational direction that is opposite to the first rotational direction, the rotation of the nut in the first rotational direction causing the shaft to travel toward the electric motor which causes the spring to compress to apply increased friction to the thread, the rotation of the nut in the second rotational direction causing the shaft to travel away from the electric motor which causes the spring to decompress to apply decreased friction to the thread.

2. The motorized thread tensioner as recited in claim 1, wherein:

the first rotational direction of the nut is a clockwise direction; and the second rotational direction of the nut is a counterclockwise direction.

3. The motorized thread tensioner as recited in claim 1, wherein the spring is in direct contact with the head of the shaft.

4. The motorized thread tensioner as recited in claim 1, wherein the nut includes:

a proximal end that defines a threaded opening that is threaded onto the threads of the shaft;

a distal end that defines a slot; and rails running between the proximal end and the distal end that define an open cavity between the rails into which the distal end of the shaft may extend as the nut is threaded onto the threads of the shaft.

5. The motorized thread tensioner as recited in claim 4, wherein the electric motor includes:

a shaft with flats extending into the slot defined in the distal end of the nut, the shaft with flats configured to rotate in order to rotate the nut in the first rotational direction and the second rotational direction.

6. The motorized thread tensioner as recited in claim 4, further comprising:

an optical sensor positioned proximate the nut and configured to track a relative motion of the nut.

7. The motorized thread tensioner as recited in claim 1, further comprising:

an electronic display device;

one or more processors; and one or more non-transitory computer-readable media storing one or more programs that are configured, when executed, to cause the one or more processors to generate and visually present, on the electronic display device, a first graphical user interface (GUI) tension preset control and a second GUI tension preset control, the first GUI tension preset control configured to store a first preset tension and the second GUI tension preset control configured to store a second preset tension that is different than the first preset tension, the first GUI tension preset control configured, upon receipt of a first input from a user, to send a first electronic signal to the electric motor to cause the electric motor to rotate the nut in the first or second rotational direction to apply the first preset tension to the thread, the second GUI tension preset control configured, upon receipt of a second input from the user, to send a second electronic signal to the electric motor to cause the electric motor to rotate the nut in the first or second rotational direction to apply the second preset tension to the thread.

8. A motorized thread tensioner for a sewing machine, the motorized thread tensioner comprising:

a first disk;

a second disk positioned next to the first disk;

a spring configured to apply friction to a thread that is positioned between the first disk and the second disk by exerting a force against the second disk;

a shaft having a head on a proximal end and threads on a distal end, the shaft being positioned through the first disk, the second disk, and the spring;

a nut threaded onto the threads of the shaft;

an electric motor coupled to the nut and configured to rotate the nut in a first rotational direction and a second rotational direction that is opposite to the first rotational direction, the rotation of the nut in the first rotational direction causing the shaft to travel toward the electric motor which causes the spring to compress to apply increased friction to the thread, the rotation of the nut in the second rotational direction causing the shaft to travel away from the electric motor which causes the spring to decompress to apply decreased friction to the thread;

an electronic display device;

one or more processors; and one or more non-transitory computer-readable media storing one or more programs that are configured, when executed, to cause the one or more processors to generate and visually present, on the electronic display device, a first graphical user interface (GUI) tension preset control and a second GUI tension preset control, the first GUI tension preset control configured to store a first preset tension and the second GUI tension preset control configured to store a second preset tension that is different than the first preset tension, the first GUI tension preset control configured, upon receipt of a first input from a user, to send a first electronic signal to the electric motor to cause the electric motor to cause the spring to compress or decompress to apply the first preset tension to the thread, the second GUI tension preset control configured, upon receipt of a second input from the user, to send a second electronic signal to the electric motor to cause the electric motor to cause the spring to compress or decompress to apply the second preset tension to the thread.

9. The motorized thread tensioner as recited in claim 8, wherein the electronic display device is a touchscreen display device.

10. The motorized thread tensioner as recited in claim 8, wherein:

the first GUI tension preset control is a first GUI tension preset button; and the second GUI tension preset control is a second GUI tension preset button.

11. The motorized thread tensioner as recited in claim 10, wherein:

the first GUI tension preset button displays the first preset tension on the first GUI tension preset button; and the second GUI tension preset button displays the second preset tension on the second GUI tension preset button.

12. The motorized thread tensioner as recited in claim 8, wherein:

the first preset tension of the first GUI tension preset control is configured to be adjusted by a user; and the second preset tension of the second GUI tension preset control is configured to be adjusted by the user.

13. A sewing machine comprising:

a needle bar configured to have a needle attached thereto and configured to reciprocate the needle having a thread threaded thereon into and out of a fabric; and a motorized thread tensioner including:

a first disk;

a second disk positioned next to the first disk;

a spring configured to apply friction to the thread, a portion of which being positioned between the first disk and the second disk, by exerting a force against the second disk;

a shaft having a head on a proximal end and threads on a distal end, the shaft being positioned through the first disk, the second disk, and the spring;

a nut threaded onto the threads of the shaft;

an electric motor coupled to the nut and configured to rotate the nut in a first rotational direction and a second rotational direction that is opposite to the first rotational direction, the rotation of the nut in the first rotational direction causing the shaft to travel toward the electric motor which causes the spring to compress to apply increased friction to the thread, the rotation of the nut in the second rotational direction causing the shaft to travel away from the electric motor which causes the spring to decompress to apply decreased friction to the thread;

an electronic display device;

one or more processors; and one or more non-transitory computer-readable media storing one or more programs that are configured, when executed, to cause the one or more processors to generate and visually present, on the electronic display device, a first graphical user interface (GUI) tension preset control and a second GUI tension preset control, the first GUI tension preset control configured to store a first preset tension and the second GUI tension preset control configured to store a second preset tension that is different than the first preset tension, the first GUI tension preset control configured, upon receipt of a first input from a user, to send a first electronic signal to the electric motor to cause the electric motor to rotate the nut in the first or second rotational direction to apply the first preset tension to the thread, the second GUI tension preset control configured, upon receipt of a second input from the user, to send a second electronic signal to the electric motor to cause the electric motor to rotate the nut in the first or second rotational direction to apply the second preset tension to the thread.

14. The sewing machine as recited in claim 13, wherein the sewing machine is a long-arm quilting machine and further comprises:

handle bars; and a presser bar having a hopping foot attached thereto and configured to reciprocate the hopping foot onto and off of the fabric while the needle bar reciprocates the needle into and out of the fabric.

15. The sewing machine as recited in claim 13, wherein the nut includes:

a proximal end that defines a threaded opening that is threaded onto the threads of the shaft;

a distal end that defines a slot; and rails running between the proximal end and the distal end that define an open cavity between the rails into which the distal end of the shaft may extend as the nut is threaded onto the threads of the shaft.

16. The sewing machine as recited in claim 15, wherein the electric motor includes:

a shaft with flats extending into the slot defined in the distal end of the nut, the shaft with flats configured to rotate in order to rotate the nut in the first rotational direction and the second rotational direction.

17. The sewing machine as recited in claim 16, wherein the motorized thread tensioner further includes:

an optical sensor positioned proximate rails of the nut and configured to track rotations or partial rotations of the nut.

18. The sewing machine as recited in claim 13, wherein:

the first GUI tension preset control is a first GUI tension preset button that displays the first preset tension on the first GUI tension preset button;

the second GUI tension preset control is a second GUI tension preset button that displays the second preset tension on the second GUI tension preset button;

the first preset tension of the first GUI tension preset button is configured to be adjusted by a user; and the second preset tension of the second GUI tension preset button is configured to be adjusted by the user.

* * * * *